US007208056B2

(12) United States Patent
Iwasaki et al.

(10) Patent No.: US 7,208,056 B2
(45) Date of Patent: Apr. 24, 2007

(54) RARE EARTH SINTERED MAGNET, AND METHOD FOR IMPROVING MECHANICAL STRENGTH AND CORROSION RESISTANCE THEREOF

(75) Inventors: Makoto Iwasaki, Tokyo (JP); Chikara Ishizaka, Tokyo (JP); Taku Takeishi, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/048,620

(22) Filed: Jan. 31, 2005

(65) Prior Publication Data

US 2005/0173025 A1 Aug. 11, 2005

(30) Foreign Application Priority Data

Feb. 10, 2004 (JP) ..... 2004-033231

(51) Int. Cl.
*H01F 1/057* (2006.01)

(52) U.S. Cl. ..... 148/302; 419/12; 75/244; 148/101; 148/122

(58) Field of Classification Search ..... None
See application file for complete search history.

(56) References Cited

U.S. PATENT DOCUMENTS 5,154,978 A 10/1992 Nakayama et al.
5,316,595 A 5/1994 Hamada et al.
2002/0054814 A1* 5/2002 Honma et al. ..... 415/55.1
2002/0057982 A1* 5/2002 Kuniyoshi et al. ..... 419/12
2003/0041920 A1* 3/2003 Hoshi et al. ..... 148/122
2003/0136471 A1* 7/2003 Kikugawa et al. ..... 148/122
2004/0069650 A1* 4/2004 Yoshimura et al. ..... 205/164

FOREIGN PATENT DOCUMENTS

JP 04-268051 9/1992
JP 08-330121 12/1996

* cited by examiner

*Primary Examiner*—John P. Sheehan
(74) *Attorney, Agent, or Firm*—Hogan & Hartson LLP

(57) ABSTRACT

An R-T-B system rare earth sintered magnet having a high mechanical strength and excellent corrosion resistance is provided. The R-T-B system rare earth sintered magnet of the present invention comprises a sintered body comprising a main phase consisting of an $R_2T_{14}B$ phase where R represents one or more rare earth elements and T represents one or more transition metal elements essentially containing Fe, or Fe and Co, and a grain boundary phase containing a higher amount of R than the above described main phase, wherein the surface of the above described sintered body is partially covered with a carbon compound layer. In the R-T-B system rare earth sintered magnet of the present invention, the area ratio of the partial surface of the above described sintered body covered with the above described carbon compound layer to the entire surface thereof is preferably between 10% and 90%.

13 Claims, 5 Drawing Sheets

| SAMPLE NO. | TYPE OF CARBON COMPOUND | AREA RATIO OF CARBON COMPOUND (%) | FLEXURAL STRENGTH (MPa) | RUST AREA IN CORROSION RESISTANT TEST (%) | Br (kG) | HcJ (kOe) |
|---|---|---|---|---|---|---|
| 1 | NONE | 0 | 220 | 80 | 13.6 | 18.4 |
| 2 | $RC_{0.4}$ | 20 | 260 | 0 | 13.6 | 18.4 |
| 3 | | 40 | 260 | 0 | 13.6 | 18.4 |
| 4 | | 60 | 300 | 0 | 13.6 | 18.4 |
| 5 | | 80 | 270 | 0 | 13.6 | 18.4 |
| 6 | | 100 | 250 | 0 | 13.6 | 18.3 |
| 7 | $R_2C_3$, $RC_{0.4}$ | 100 | 230 | 0 | 13.4 | 17.5 |

FIG. 1

| SAMPLE NO. | TYPE OF CARBON COMPOUND | AREA RATIO OF CARBON COMPOUND (%) | FLEXURAL STRENGTH (MPa) | RUST AREA IN CORROSION RESISTANT TEST (%) | Br (kG) | HcJ (kOe) |
|---|---|---|---|---|---|---|
| 1 | NONE | 0 | 220 | 80 | 13.6 | 18.4 |
| 2 | $RC_{0.4}$ | 20 | 260 | 0 | 13.6 | 18.4 |
| 3 | | 40 | 260 | 0 | 13.6 | 18.4 |
| 4 | | 60 | 300 | 0 | 13.6 | 18.4 |
| 5 | | 80 | 270 | 0 | 13.6 | 18.4 |
| 6 | | 100 | 250 | 0 | 13.6 | 18.3 |
| 7 | $R_2C_3$, $RC_{0.4}$ | 100 | 230 | 0 | 13.4 | 17.5 |

RARE EARTH SINTERED MAGNET, AND METHOD FOR IMPROVING MECHANICAL STRENGTH AND CORROSION RESISTANCE THEREOF

BACKGROUND OF THE INVENTION

1. Field of the Invention

The present invention relates to an R-T-B system rare earth sintered magnet comprising R (R represents one or more rare earth elements), T (T represents at least one transition metal element essentially containing Fe, or Fe and Co), and B (boron) as main components.

2. Description of the Related Art

Among rare earth sintered magnets, an R-T-B system rare earth sintered magnet has been adopted in various types of electric equipment for the reasons that its magnetic properties are excellent and that its main component Nd is abundant as a source and relatively inexpensive.

However, such an R-T-B system rare earth sintered magnet with excellent magnetic properties also has several technical problems to be solved. Such a technical problem is corrosion resistance. That is, since the R-T-B system rare earth sintered magnet comprises, as main constituent elements, R and Fe, which are easily oxidized, it is poor in corrosion resistance. Thus, the surface of the R-T-B rare earth sintered magnet is generally covered with a corrosion resistant overcoat. As such an overcoat, metal plating or resin is used depending on purposes. However, needless to say, it is desired that the corrosion resistance of the sintered magnet itself be improved to achieve higher corrosion resistance.

Another technical problem of the R-T-B system rare earth sintered magnet is mechanical strength. That is, since the R-T-B system rare earth sintered magnet is produced by the powder metallurgy, its mechanical strength is not necessarily sufficient. Thus, when the sintered magnet is applied to a thin magnet, working is not easy.

Japanese Patent Application Laid-Open No. 8-330121 describes the improvement of the corrosion resistance and mechanical strength of a sintered magnet. It proposes that a carbon-enriched layer having a concentration that is 2 times or more than the mean carbon concentration of a sintered magnet is formed on the surface of the sintered magnet at a thickness between 3 and 300 μm. Japanese Patent Application Laid-Open No. 8-330121 discloses that the carbon enriched on the surface of the sintered magnet forms a carbon-R system compound together with R contained in the sintered magnet, and that this carbon-R system compound enhances the strength of the sintered magnet as well as acting as a corrosion resistant overcoat. In addition, the same publication also discloses that when the thickness of the carbon-enriched layer is less than 3 μm, its effect is not exhibited, and when the thickness is over 300 μm, magnetic properties are significantly decreased. The same above publication also discloses a method of forming a carbon-enriched layer, which comprises immersing a compacted body before being sintered in a butyl alcohol solution, in which 5% by weight of carbon powders are suspended, at a room temperature for a certain period of time.

Higher properties are required for an R-T-B system rare earth sintered magnet. In particular, in response to-the-needs for miniaturization of electronic equipment, a further improvement of mechanical strength is required.

SUMMARY OF THE INVENTION

The present invention has been completed to solve these technical problems. Hence, it is an object of the present invention to provide a rare earth sintered magnet having a high mechanical strength and excellent corrosion resistance.

The technique of establishing a covering layer consisting of a carbon-enriched layer disclosed in Japanese Patent Application Laid-Open No. 8-330121 is effective for the improvement of mechanical strength and corrosion resistance. The present inventors have found that it is desired for the improvement of mechanical strength that a sintered body be partially covered with such a covering layer rather than the formation of the covering layer on the entire surface of the sintered body. Such partial covering brings on corrosion resistance equivalent to that in the case of covering the entire surface. There are two types of compounds $R_2C_3$ and $RC_{0.4}$, which form the aforementioned carbon-enriched layer. The present inventors have also found that a covering layer comprises $RC_{0.4}$ is more effective for the improvement of mechanical strength. The present invention has been completed based on the aforementioned findings. The present invention provides a rare earth sintered magnet comprising a sintered body, in which the sintered body comprises a main phase consisting of an $R_2T_{14}B$ phase where R represents one or more rare earth elements and T represents one or more transition metal elements essentially containing Fe, or Fe and Co and a grain boundary phase containing a higher amount of R than the above described main phase, wherein the surface of the above described sintered body is partially covered with a carbon compound layer.

In the rare earth sintered magnet of the present invention, the area ratio of the partial surface of the above described sintered body covered with the above described carbon compound layer to the entire surface thereof is preferably between 10% and 90%.

In the rare earth sintered magnet of the present invention, the carbon compound preferably comprises $RC_{0.4}$ for the improvement of mechanical strength. In addition, it is preferable that the above described carbon compound layer directly covers the grain boundary phase of the sintered body.

Moreover, the present invention provides a rare earth sintered magnet comprising a sintered body, in which the sintered body comprises a main phase consisting of an $R_2T_{14}B$ phase where R represents one or more rare earth elements and T represents one or more transition metal elements essentially containing Fe, or Fe and Co; and a grain boundary phase containing a higher amount of R than the above described main phase; wherein the surface of the above described sintered body is covered with a carbon compound layer consisting essentially of $RC_{0.4}$. In this rare earth sintered magnet, the entire surface of the sintered body may be covered with the carbon compound layer consisting essentially of $RC_{0.4}$, but it is preferable that the surface be partially covered therewith.

The present invention provides a method for improving the mechanical strength and corrosion resistance of a rare earth sintered magnet. This method improves the mechanical strength and corrosion resistance of a rare earth sintered magnet, in which the rare earth sintered magnet comprises a sintered body comprising a main phase consisting of an $R_2T_{14}B$ phase where R represents one or more rare earth elements and T represents one or more transition metal elements essentially containing Fe, or Fe and Co and a grain boundary phase containing a higher amount of R than the above described main phase, wherein the above described method comprises preparing a compacted body by compacting alloy powders with a predetermined composition in a magnetic field, and sintering the above described compacted body in an atmosphere containing a carbon-containing compound.

The present invention can provide an R-T-B system rare earth sintered magnet having a high mechanical strength and excellent corrosion resistance.

BRIEF DESCRIPTION OF THE DRAWINGS

FIG. 1 is a table showing the results obtained by measuring the flexural strength, corrosion resistance, and magnetic properties of each of Sample Nos. 1 to 7;

DETAILED DESCRIPTION OF THE PREFERRED EMBODIMENTS

Figure 2:
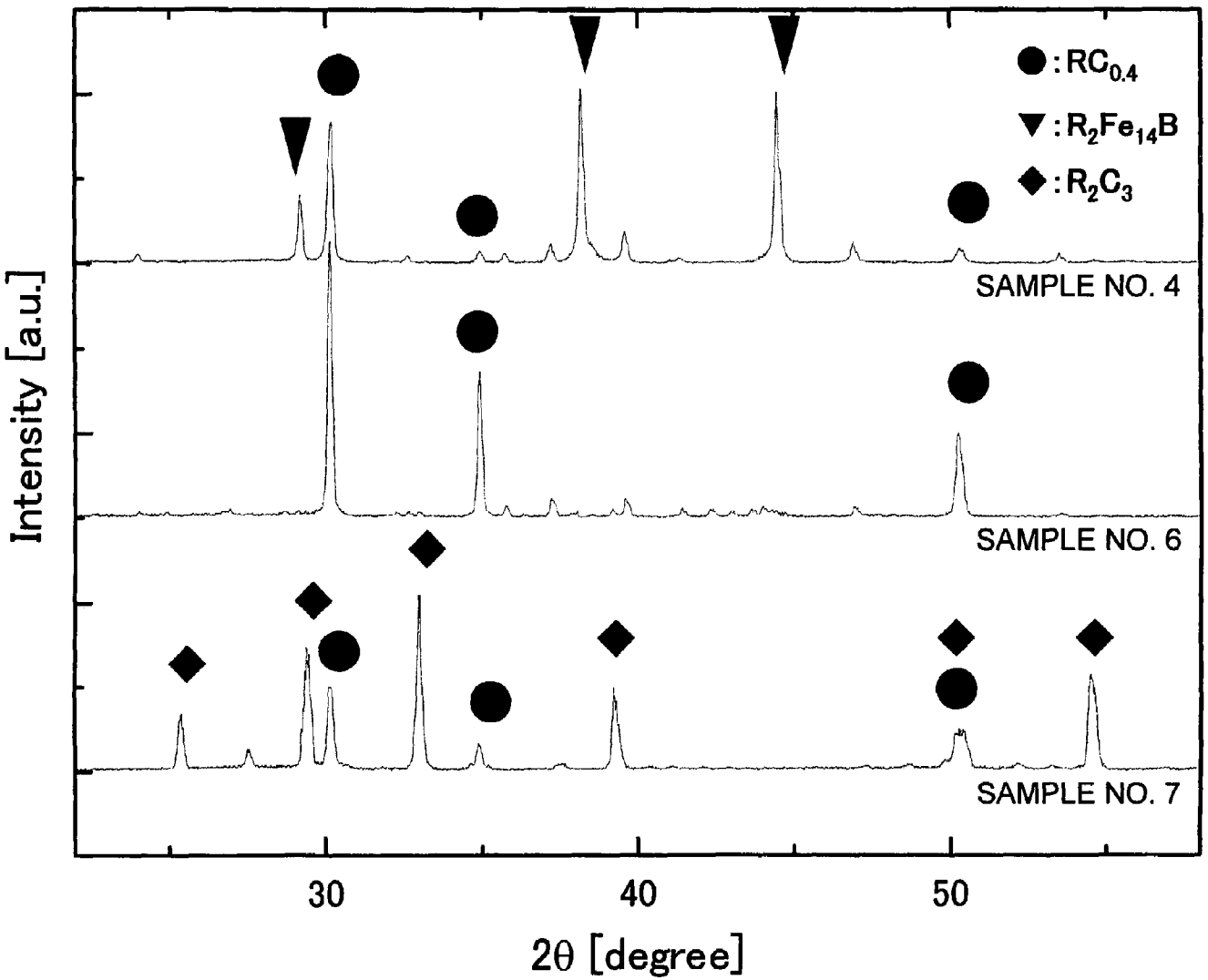
FIG. 2 is a chart showing the results obtained by observing each of Sample Nos. 4, 6, and 7 by XRD (X-ray diffractometer)

The present invention will be described in detail in the following embodiments.

<Microstructure>

As is well known, the R-T-B system rare earth sintered magnet of the present invention comprises a sintered body comprising at least a main phase consisting of $R_2T_{14}B$ crystal grains (R represents one or more rare earth elements, and T represents one or more transition metal elements essentially containing Fe, or Fe and Co) and a grain boundary phase containing a higher amount of R than the above described main phase. It is said that such a grain boundary phase, which is a phase constituting the R-T-B system rare earth sintered magnet, is a starting point of corrosion.

<Chemical Composition>

The R-T-B system rare earth sintered magnet of the present invention contains 25% to 37% by weight of rare earth elements (R).

Herein, R in the present invention has a concept of including Y. Accordingly, R represents one or more elements selected from the group consisting of Y, La, Ce, Pr, Nd, Sm, Eu, Gd, Tb, Dy, Ho, Er, Tm, Yb, and Lu. If the amount of R is less than 25% by weight, an $R_2T_{14}B$ phase as a main phase of the R-T-B system rare earth sintered magnet might be insufficiently generated. Accordingly, α-Fe or the like having soft magnetism is deposited, and the coercive force thereby significantly decreases. On the other hand, if the amount of R exceeds 37% by weight, the volume ratio of the $R_2T_{14}B$ phase as a main phase decreases, and the residual magnetic flux density also decreases. Moreover, if the amount of R exceeds 37% by weight, R reacts with oxygen, and the content of oxygen thereby increases. In accordance with the increase of the oxygen content, a grain boundary phase effective for the generation of the coercive force decreases, resulting in a decrease in coercive force. Therefore, the amount of R is set between 25% and 37% by weight. The amount of R is preferably between 28% and 35% by weight, and more preferably between 29% and 33% by weight.

In addition, the R-T-B system rare earth sintered magnet of the present invention contains 0.5% to 4.5% by weight of boron (B). If the amount of B is less than 0.5% by weight, a high coercive force cannot be obtained. However, if the amount of B exceeds 4.5% by weight, the residual magnetic flux density is likely to decrease. Accordingly, the upper limit is set at 4.5% by weight. The amount of B is preferably between 0.5% and 1.5% by weight, and more preferably between 0.8% and 1.2% by weight.

Moreover, the R-T-B system rare earth sintered magnet of the present invention contains Co in an amount of 2.0% or less by weight (excluding 0), preferably between 0.1% and 1.0% by weight, and more preferably between 0.3% and 0.7% by weight. Co forms the same phase as that formed by Fe. Co has an effect to improve Curie temperature and the corrosion resistance of a grain boundary phase.

Furthermore, the R-T-B system rare earth sintered magnet of the present invention may contain Al and/or Cu within the range between 0.02% and 0.5% by weight. Containing of Al and/or Cu within the above range can impart a high coercive force, high corrosion resistance, and improved temperature stabilities to the obtained sintered magnet. When Al is added, the additive amount of Al is preferably between 0.03% and 0.3% by weight, and more preferably between 0.05% and 0.25% by weight. When Cu is added, the additive amount of Cu is preferably 0.15% or less by weight (excluding 0), and more preferably between 0.03% and 0.12% by weight.

The R-T-B system rare earth sintered magnet of the present invention is permitted to contain other elements. For example, it can appropriately contain elements such as Zr, Ti, Bi, Sn, Ga, Nb, Ta, Si, V, Ag, or Ge. On the other hand, it is desired that impurity elements such as oxygen, nitrogen, or carbon be reduced to the minimum. In particular, the amount of oxygen impairing magnetic properties is set preferably at 5,000 ppm or less, and more preferably at 3,000 ppm or less. If the amount of oxygen is large, a rare earth oxide phase as a non-magnetic component increases, thereby reducing magnetic properties.

<Production Method>

The method for producing a rare earth sintered magnet of the present invention will be described below.

A starting alloy can be produced by strip casting or other known dissolution methods in a vacuum or an inert gas atmosphere, and preferably in an Ar atmosphere. When the rare earth sintered magnet of the present invention is produced by what is called a mixing method using an alloy (low R alloy) containing $R_2T_{14}B$ crystal grains as main components and another alloy (high R alloy) containing a higher amount of R than the low R alloy, such starting alloys are produced in the same manner as described above.

The starting alloy is subjected to a crushing process. In the case of applying the mixing method, a low R alloy and a high R alloy are crushed separately or together. The crushing process includes roughly crushing and pulverizing. First, each of the starting alloys is crushed to a particle size of approximately several hundreds of μm. The crushing is preferably carried out in an inert gas atmosphere, using a stamp mill, a jaw crusher, a brown mill, etc. Crushing can be carried out more effective after absorbing hydrogen in the starting alloys and then releasing it. This hydrogen-assisted crushing can also be used as crushing instead of mechanical crushing.

After carrying out the crushing, the routine proceeds to a pulverizing process. In the pulverizing process, a jet mill is mainly used, and crushed powders with a particle size of approximately several hundreds of μm are crushed to a mean particle size between 2.5 and 6 μm, and more preferably 3 and 5 μm. The jet mill is a method comprising releasing a high-pressure inert gas through a narrow nozzle so as to generate a high-speed gas flow, accelerating the crushed powders with the high-speed gas flow, and making crushed powders hit against each other, the target, or the wall of the container, so as to crush the powders.

In the case of applying the mixing method, a timing of mixing of two types of alloys is not limited. However, when the low R alloy and the high R alloy are crushed separately in the pulverizing process, the pulverized low R alloy powders are mixed with the pulverized high Ralloy powders in a nitrogen atmosphere. The mixing ratio of the low R alloy powders and the high R alloy powders may be approximately between 80:20 and 97:3 at a weight ratio. Likewise, in a case where the low R alloy is crushed together with the high R alloy also, the same above mixing ratio may be applied. For the purpose of improving lubrication or orientation during compacting, approximately 0.01% to 0.3% by weight of fatty acid or a derivative thereof, for example, stearic acid based one and oleic acid based one such as zinc stearate, calcium stearate, stearic amide, or oleic amide, can be added during the pulverizing process.

The thus obtained fine powders are then compacted in a magnetic field.

A compacting pressure applied during compacting in a magnetic field maybe within the range between 0.3 and 3 ton/cm$^2$ (between 30 and 300 MPa). Such a compacting pressure may be constant from the initiation of compacting to the termination thereof, or may also gradually be increased or decreased. Otherwise, it may also be altered irregularly. Lower the compacting pressure, higher the orientation that can be obtained. However, if the compacting pressure is too low, the strength of a compacted body is insufficient, and a problem regarding handling might occur. Thus, considering such a respect, the compacting pressure is selected from the aforementioned range. The relative density of a compacted body finally obtained by compacting in a magnetic field is generally between 50% and 60%.

A magnetic field applied may be set approximately between 12 and 20 kOe (between 960 and 1,600 kA/m). In addition, the magnetic field applied is not limited to a static magnetic field, but a pulse magnetic field can also be used. Moreover, it is also possible to use a static magnetic field and a pulse magnetic field in combination.

After the compacting in the magnetic field, the compacted body is sintered in a vacuum or an inert gas atmosphere. The sintering temperature needs to be adjusted depending on various conditions such as a composition, a crushing (pulverizing) method, the difference between mean particle size and particle size distribution. The compacted body may be sintered at 1,000° C. to 1,200° C. for about 1 to 10 hours.

The carbon compound layer of the present invention can be formed during this sintering process. That is to say, sintering is carried out in a state where a carbon-containing compound is placed in the sintering atmosphere, so as to form the carbon compound layer of the present invention. Examples of a carbon-containing compound that can preferably be used herein may include fatty acid and a derivative thereof, for example, stearic acid based one and oleic acid based one, such as zinc stearate, calcium stearate, stearic amide, or oleic amide. Carbon black, graphite, charcoal, and the like can also be used as carbon-containing compounds. As described in Japanese Patent Application Laid-Open No. 8-330121, when a sintered magnet is immersed in a butyl alcohol solution, in which carbon powders are suspended, at a room temperature for a certain period of time, and the resultant magnet is then sintered, a carbon compound layer is formed on the entire surface of the sintered magnet, and the compound comprises $R_2C_3$ as a main component. In contrast, in the case of the carbon compound obtained by placing a carbon-containing compound in a sintering atmosphere as described above, it comprises $RC_{0.4}$ as a main component, and it can be partially formed on the surface of the sintered magnet. It is desired for the improvement of mechanical strength that such a carbon compound layer comprising $RC_{0.4}$ be partially formed on the surface of the sintered magnet, rather than the formation of the carbon compound layer on the entire surface thereof. The ratio of the carbon compound layer covering the surface of the sintered magnet is between 10% and 90%, preferably between 20% and 80%, and more preferably between 30% and 80% in terms of area ratio. In the present invention, it is desired that the carbon compound layer only consist of $RC_{0.4}$, but the presence of $R_2C_3$ is acceptable. In this case, using XRD, the maximum peak intensity of $RC_{0.4}$ is compared with that of $R_2C_3$. If the maximum peak intensity of $R_2C_3$ is 10% or less of that of $RC_{0.4}$, the presence of $R_2C_3$ may not significantly affect the effects of the present invention.

After completion of the sintering, the obtained sintered body may be subjected to an aging treatment. The aging treatment is important for the increase of a coercive force. When the aging treatment is carried out in two steps, it is effective to retain the sintering body for a certain period of time at around 800° C. and around 600° C. When the aging treatment is carried out in a single step, it is appropriate to carry it out at around 600° C.

After obtaining a sintered body, an overcoat can be formed thereon. The formation of an overcoat may be carried out by known methods, depending on the type of the overcoat. For example, when electroplating is adopted, it may be formed by the following steps by the common procedure:

Working of the sintered body→Barreling→Degreasing→Water washing→Etching (e.g., with nitric acid)→Water washing→Electroplating for forming the overcoat→Water washing→Drying By forming such an overcoat on the R-T-B system rare earth sintered magnet of the present invention, corrosion resistance are further improved.

EXAMPLE 1

An alloy consisting of 31% by weight of Nd, 0.2% by weight of Al, 0.5% by weight of Co, 0.07% by weight of Cu, 1.0% by weight of B, and the balance being Fe was produced by the strip casting method. A hydrogen absorption and dehydrogenation treatment was carried out, such that hydrogen was absorbed in the obtained strip cast alloy at room temperature, and that the dehydrogenation was then conducted at a temperature of 500° C.

Thereafter, a crushing with a stamp mill and a pulverizing with a jet mill were carried out, so as to obtain fine powders having a mean particle size of 4.0 μm. When the pulverizing was carried out with a jet mill, 0.1% by weight of oleic amide was added.

Subsequently, the fine powders were compacted with a pressure of 1.5 ton/cm$^2$ in a magnetic field of 15 kOe. The obtained compacted body was sintered by retaining it at 1,050° C. for 4 hours. The compacted body was placed in a box-like container, and then, such sintering was carried out in two cases: a case where oleic amide was placed in the container; and the other case where oleic amide was not placed therein. Moreover, even in the case where oleic amide was placed in the container, the amount of oleic amide was varied, and sintering was carried out. Furthermore, in accordance with the method disclosed in Japanese Patent Application Laid-Open No. 8-330121, a compacted body before subjecting to sintering was immersed in a butyl alcohol solution, in which 5% by weight of carbon powders were suspended, at room temperature, and then, sintering was carried out.

A carbon compound formed on the surface of the obtained sintered body was identified by XRD, and the area ratio of the carbon compound covering the surface of the sintered body was determined by EPMA. Measurement conditions for XRD and EPMA are as follows:

XRD: the X-ray diffraction was carried out using a Cu tube at an output of 3 kW.

EPMA: EPMA1600 manufactured by Shimadzu Corp. was used, and the following measurement conditions were applied:

Analyzing crystal: Fe, Nd: LiF, C: LS12L, and O: LS7A

Accelerating voltage: 15 kV

Current applied: 0.12 μA

Time when current is applied: 50 ms

Measurement point: 200×200 points

Scope: 100 μm×100 μm

Moreover, concerning the obtained sintered body, the measurement of flexural strength, corrosion resistant test, and the measurement of residual magnetic flux density (Br) and coercive force (HcJ) were carried out. The results are shown in FIG. 1. The corrosion resistant test was evaluated by measuring the area ratio of rust generated after leaving the sintered body for 24 hours in a condition of a temperature of 80° C. and a humidity of 20%. Residual magnetic flux density (Br) and coercive force (HcJ) were measured using a B-H tracer.

Figure 5:
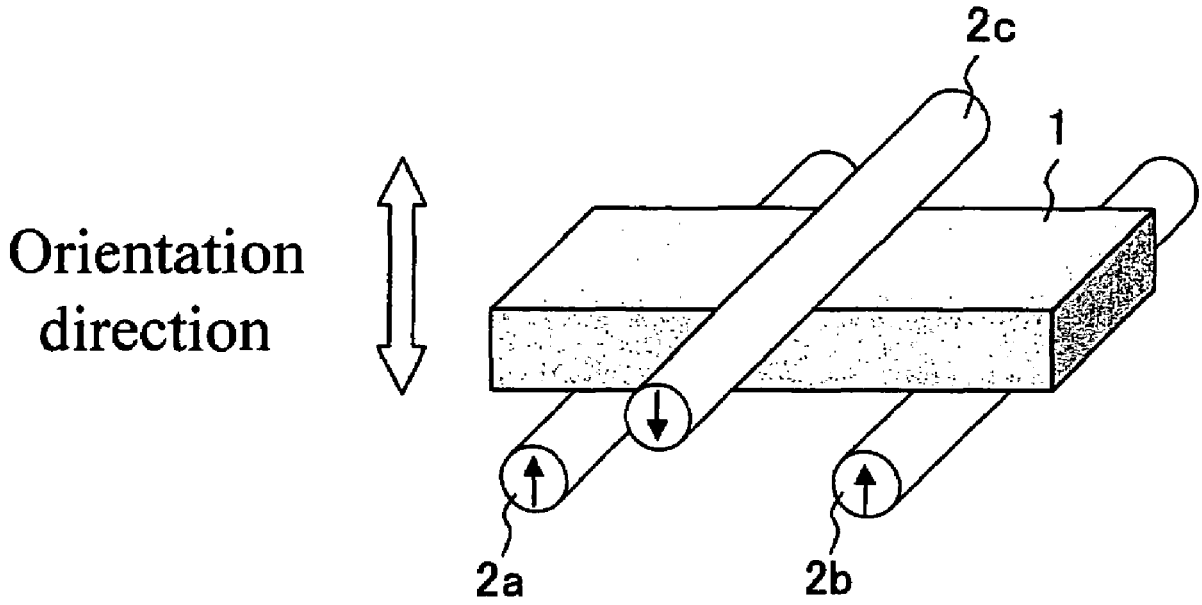
FIG. 5 shows the way how to measure the flexural strength in the present embodiment.

Flexural strength was measured in accordance with the Japanese Industrial Standards, JIS R 1601. That is to say, as shown in FIG. 5, a sintered body 1 was placed on two round-bar supports 2*a* and 2*b*, and a round bar 2*c* was placed at the center in the longitudinal direction of the sintered body 1. Thereafter, a load (a flexural pressure) was imposed thereon, so as to measure flexural strength. The direction to which the flexural pressure was applied, was an orientation direction. The size of the sintered body 1 was set at 40 mm×10 mm×5 mm.

As shown in FIG. 1, in the case of sample No. 1 wherein no carbon compound layers were formed, the results of the corrosion resistant test was significantly poor, and thus, it was confirmed that the sample was problematic regarding corrosion resistance.

In contrast, in the case of sample Nos. 2 to 6 wherein $RC_{0.4}$ was formed on the surface of the sintered body, it was found that the flexural strength was higher than that of sample No. 1, and that the corrosion resistance was also improved. Among sample Nos. 2 to 6 wherein $RC_{0.4}$ was formed, sample No. 4 wherein the area ratio of the carbon compound ($RC_{0.4}$) layer was 60% had the highest flexural strength, and it was not problematic regarding corrosion resistance. Accordingly, the area ratio of the carbon compound ($RC_{0.4}$) layer is set preferably between 30% and 80%, and more preferably between 50% and 70% It is understand that the sintered body had such excellent corrosion resistance even by being partially covered with the carbon compound because the carbon compound ($RC_{0.4}$) layer was preferentially formed on a grain boundary phase that was a starting point of cauterization.

FIG. 2 is a chart showing the results obtained by observing sample Nos. 4, 6, and 7 by XRD. In sample No. 4 wherein the area ratio of the carbon compound ($RC_{0.4}$) layer to the entire surface of the sintered body was 60%, an $R_2Fe_{14}B$ phase as a main phase and an $RC_{0.4}$ phase were observed. On the other hand, in sample No. 6 wherein the carbon compound ($RC_{0.4}$) layer was formed on the entire surface of the sintered body, the $RC_{0.4}$ phase was observed, but the $R_2Fe_{14}B$ phase could not be observed. Moreover, in sample No. 7 wherein the carbon compound ($R_2C_3$, $RC_{0.4}$) layer was formed on the entire surface of the sintered body (which was produced in accordance with Japanese Patent Application Laid-Open No. 8-330121), the carbon compound ($R_2C_3$, $RC_{0.4}$) could be observed, but the $R_2Fe_{14}B$ phase could not be observed.

Figure 3:
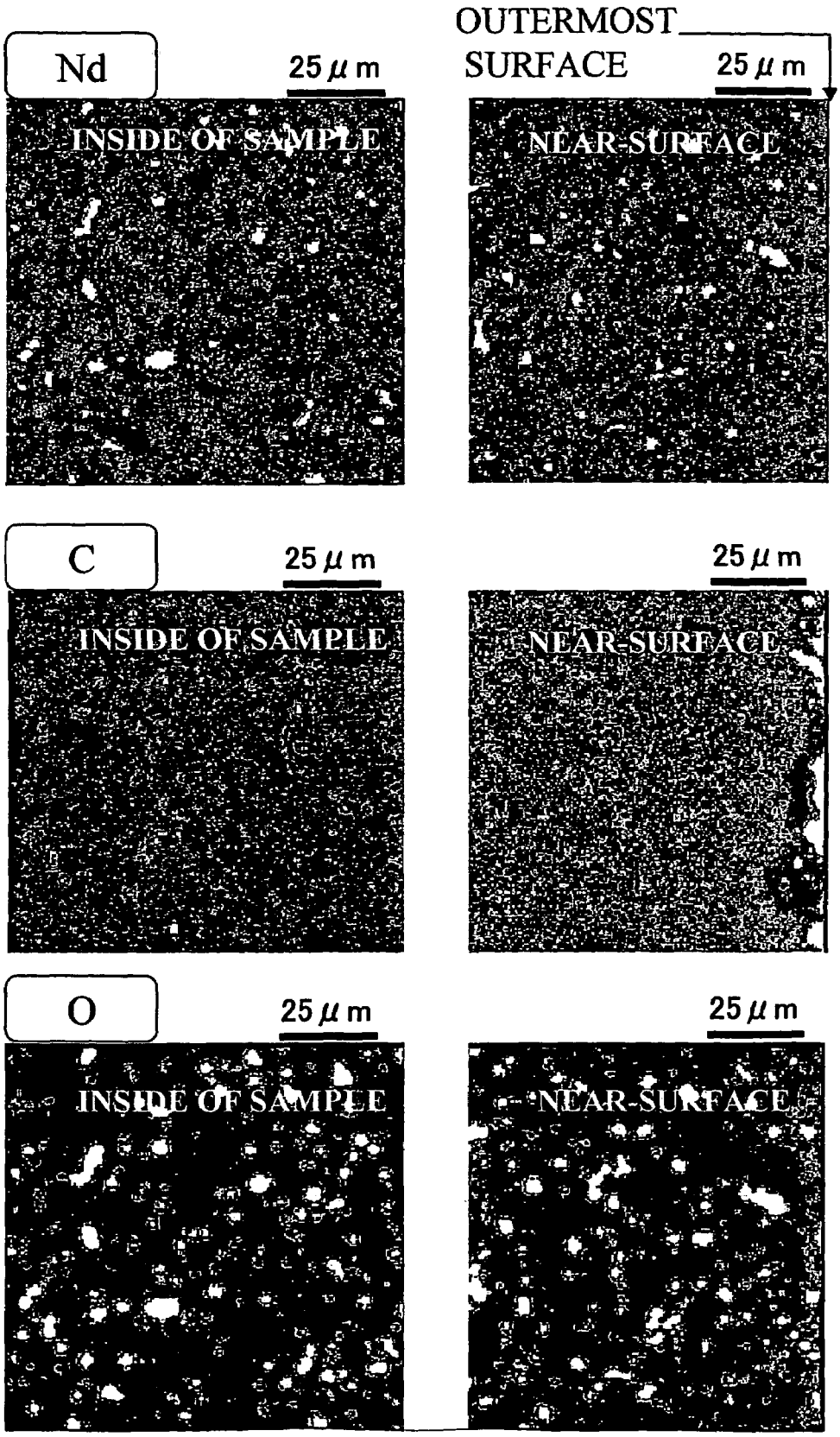
FIG. 3 shows the results obtained by observing the section of the sintered body of Sample No. 4 by EPMA(Electron Probe Micro Analyzer)
Figure 4:
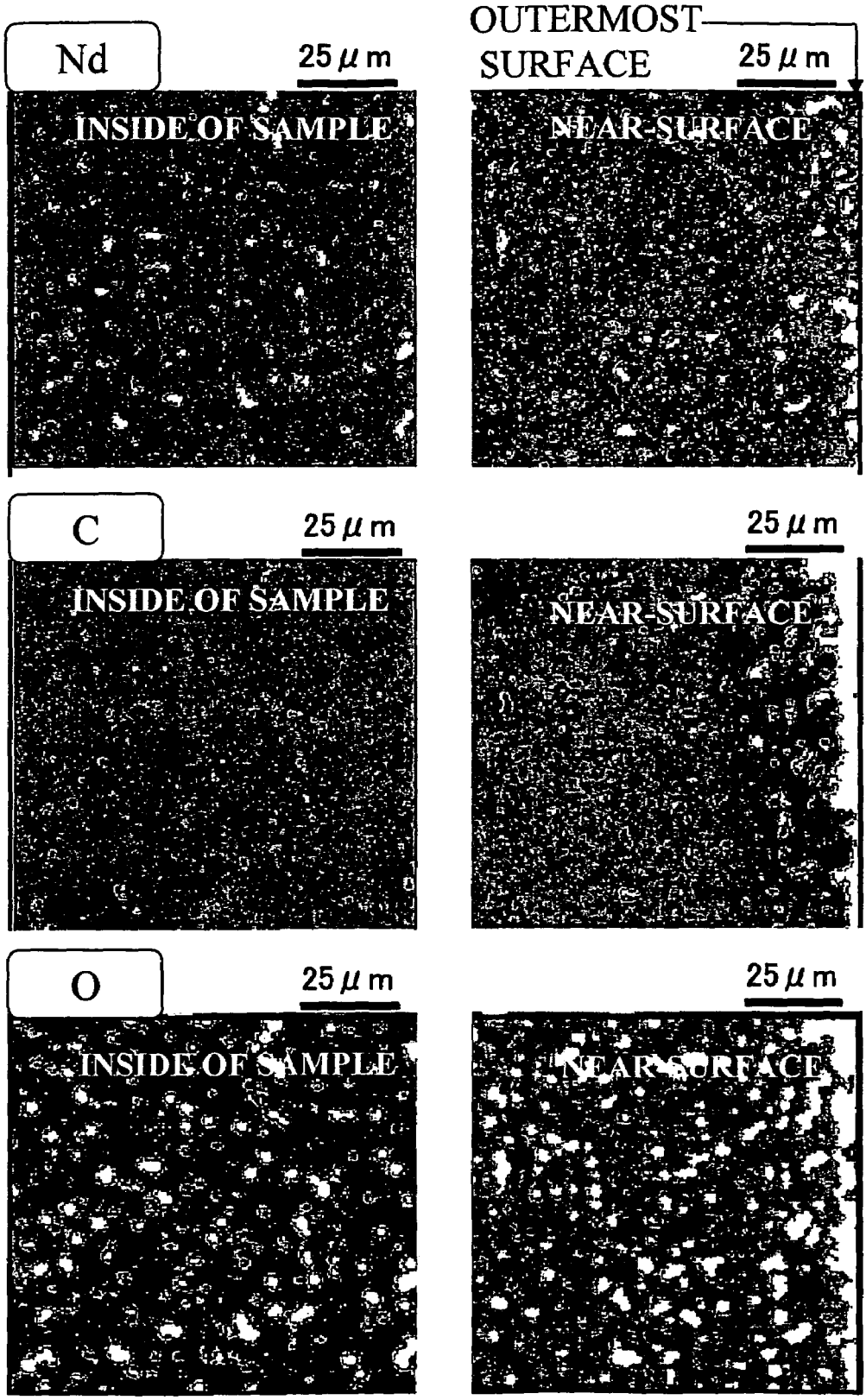
FIG. 4 shows the results obtained by observing the section of the sintered body of Sample No. 7 by EPMA.

With regard to each of the sintered bodies of sample Nos. 4 and 7, the section was observed by EPMA. The results are shown in FIGS. 3 and 4. As shown in FIG. 3, sample No. 4 has a portion with a high concentration of carbon (C) near the surface thereof. However, such a carbon portion does not cover the entire surface of the sintered body, but it is found that it only partially covers the surface thereof. In contrast, in the case of sample No. 7, a layer with a high concentration of carbon (C) is formed on the entire surface of the sintered body, as shown in FIG. 2. In addition, in the case of No. 7, the surface also has a high concentration of oxygen (O). It is assumed that such a layer with a high concentration of oxygen would cause a flexural strength that is lower than that of sample No. 4.

What is claimed is:

1. A rare earth sintered magnet comprising a sintered body, in which said sintered body comprises: a main phase consisting of an $R_2T_{14}B$ phase where R represents one or more rare earth elements and T represents one or more transition metal elements essentially containing Fe, or Fe and Co; and a grain boundary phase containing a higher amount of R than said main phase, wherein the surface of said sintered body is partially covered with a carbon compound layer comprising $RC_{0.4}$ and the area ratio of the partial surface of said sintered body covered with said carbon compound layer to the entire surface thereof is between 10% and 90%.

2. The rare earth sintered magnet according to claim 1, wherein the area ratio of the partial surface of said sintered body covered with said carbon compound layer to the entire surface thereof is between 20% and 80%.

3. The rare earth sintered magnet according to claim 1, wherein said carbon compound layer directly covers said grain boundary phase.

4. The rare earth sintered magnet according to claim 1, wherein said sintered body has a composition consisting essentially of 25% to 37% by weight of R, 0.5% to 4.5% by weight of B, 0.02% to 0.5% by weight of Al and/or Cu, 2% or less by weight (excluding O) of Co, and the balance substantially being Fe.

5. The rare earth sintered magnet according to claim 1, wherein the flexural strength of said sintered body is 250 MPa or more.

6. The rare earth sintered magnet according to claim 1, wherein the area ratio of the surface of said sintered body covered with said carbon compound layer to the entire surface thereof is between 50% and 70%.

7. The rare earth sintered magnet according to claim 6, wherein the flexural strength of said sintered body is 270 MPa or more.

8. A method for improving the mechanical strength and corrosion resistance of a rare earth sintered magnet, in which the rare earth sintered magnet comprises a sintered body comprising: a main phase consisting of an $R_2T_{14}B$ phase where R represents one or more rare earth elements and T represents one or more transition metal elements essentially containing Fe, or Fe and Co; and a grain boundary phase containing a higher amount of R than said main phase, wherein said method comprises:

preparing a compacted body by compacting allay powders with a predetermined composition in a magnetic field; and sintering said compacted body into a sintered body in a state where a carbon-containing compound is placed in a sintering atmosphere for sintering the compacted body.

9. The method for improving the mechanical strength and corrosion resistance of a rare earth sintered magnet according to claim 8, wherein $RC_{0.4}$ is formed from said carbon-containing compound through the sintering and said sintered body is partially covered with a carbon compound layer comprising $RC_{0.4}$.

10. The method for improving the mechanical strength and corrosion resistance of a rare earth sintered magnet according to claim 8, wherein said carbon-containing compound is placed outside said compacted body.

11. The method for improving the mechanical strength and corrosion resistance of a rare earth sintered magnet according to claim 8, wherein said carbon-containing compound is fatty acid or a derivative thereof.

12. The method for improving the mechanical strength and corrosion resistance of a rare earth sintered magnet according to claim 8, wherein said carbon-containing compound is at least one selected from zinc stearate, calcium stearate, stearic amide, and oleic amide.

13. A method for improving the mechanical strength and corrosion resistance of a rare earth sintered magnet, in which the rare earth sintered magnet comprises a sintered body comprising: a main phase consisting of an $R_2T_{14}B$ phase where R represents one or more rare earth elements and T represents one or more transition metal elements essentially containing Fe, or Fe and Co; and a grain boundary phase containing higher amount of R than said main phase, wherein said method comprises:

preparing a compacted body by compacting alloy powders with a predetermined composition in a magnetic field; and sintering said compacted body into a sintered body in a state where a carbon-containing compound is placed in a sintering atmosphere for sintering the compacted body;

wherein said carbon-containing compound is at least one selected from carbon black, graphite, and charcoal.

* * * * *